US007862343B1

(12) United States Patent
Lin et al.

(10) Patent No.: US 7,862,343 B1
(45) Date of Patent: Jan. 4, 2011

(54) ELECTRICAL CONNECTOR HAVING CONTACT WITH UPPER TERMINAL AND LOWER TERMINAL

(75) Inventors: Chun-Fu Lin, Tu-Cheng (TW); Ke-Hao Chen, Tu-Cheng (TW); Hsiu-Yuan Hsu, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/823,131

(22) Filed: Jun. 25, 2010

(30) Foreign Application Priority Data

Jun. 25, 2009 (TW) ..... 98211457 U

(51) Int. Cl.
*H01R 12/00* (2006.01)

(52) U.S. Cl. ..... 439/66

(58) Field of Classification Search ..... 439/66, 439/591, 908

See application file for complete search history.

(56) References Cited

U.S. PATENT DOCUMENTS 7,182,605 B2 * 2/2007 Sun et al. ..... 439/66

7,473,104 B1 * 1/2009 Wertz ..... 439/66

FOREIGN PATENT DOCUMENTS

TW M350121 2/2009

* cited by examiner

*Primary Examiner*—Tho D Ta
(74) *Attorney, Agent, or Firm*—Andrew C. Cheng; Wei Te Chung; Ming Chieh Chang

(57) ABSTRACT

An electrical connector includes an insulative housing and a plurality of contacts. The insulative housing have a top surface, a bottom surface, and a plurality of passageways extending through the top and the bottom surfaces. Each contact includes an upper terminal mounted into the passageway form the top surface and a lower terminal mounted into the passageway from the bottom surface. The upper terminal is configured with an upper retention portion and an upper spring arm extending beyond the top surface of the insulative housing. The lower terminal is configured with a lower retention portion, a lower spring arm extending beyond the bottom surface of the insulative housing, and a lower engaging portion extending upwardly from the lower retention portion to elastically contact with the upper terminal.

19 Claims, 12 Drawing Sheets

ELECTRICAL CONNECTOR HAVING CONTACT WITH UPPER TERMINAL AND LOWER TERMINAL

BACKGROUND OF THE INVENTION

1. Field of the Invention

The present invention relates to an electrical connector, and more particularly to an electrical connector which has contact with an upper terminal and a lower terminal received in a passageway of an insulative housing, and the lower terminal can elastically engage with the upper terminal to obtain a well electrical connection therebetween.

2. Description of Related Art

Referring to FIGS. 1 and 2, Taiwanese Utility Pat No. M350121 issued to Hsiao et al. on Feb. 1, 2009 discloses an electrical connector having an insulative housing 4' and a plurality of contacts 100' received in the insulative housing 4'. The insulative housing 4' includes an upper body 41' and a lower body 42, the contacts 100' comprises a first contact 1', a second contact 2', and a spring member 3' disposed around the first and the second contacts 1', 2'. The first contact 1' includes an upper mating portion 12' at a tip thereof and an engaging portion 14' at a tail thereof; the second contact 2' includes a lower mating portion 22' and a pair of clipping portions 21'. The engaging portion 14' needs to insert into the clipping portions 21' to establish an electrical connection between the first and the second contacts 1', 2'.

However, the electrical connector disclosed by Hsiao is difficult to establish electrical connection between the first and the second contacts 1', 2' due to the inserting process. Furthermore, the electrical connector still needs a spring member 3' to provide an elasticity between the first and the second contacts 1', 2' and two insulative bodies 41', 42' to assemble the contacts 100'. Therefore, the complex structure of the electrical connector causes a high cost.

Therefore, there is a need to provide a new electrical connector with an improved contact to overcome the above-mentioned problems.

SUMMARY OF THE INVENTION

An object of the present invention is to provide an electrical connector, and more particularly to provide an electrical connector having a contact configured with an upper terminal and a lower terminal which can elastically engage with the upper terminal to facility obtain a well electrical connection therebetween.

To achieve the aforementioned object, an electrical connector comprises an insulative housing and a plurality of contacts received in the passageways respectively. The insulative housing has a top surface, a bottom surface, and a plurality of passageways extending through the top and the bottom surfaces. Each contact includes an upper terminal mounted into the passageway from the top surface and a lower terminal mounted into the passageway from the bottom surface. The upper terminal is configured with an upper retention portion and an upper spring arm extending beyond the top surface of the insulative housing. The lower terminal is configured with a lower retention portion, a lower spring arm extending beyond the bottom surface of the insulative housing, and a lower engaging portion extending upwardly from the lower retention portion to elastically contact with the upper terminal.

To further achieve the aforementioned object, an electrical connector used for electrically connecting a CPU and a printed circuit board, comprises an insulative housing and having a plurality of contacts. The insulative housing includes a top surface, a bottom surface at opposite side of the top surfaces, and a plurality of passageways extending through the top and the bottom surface. Each contact received in the passageways respectively comprises an upper terminal and a lower terminal. The upper terminal is configured with a planar upper retention portion and an upper spring arm extending beyond the top surface of the insulative housing. The lower terminal is configured with a lower retention portion, a lower spring arm extending beyond the bottom surface of the insulative housing, and a lower engaging portion extending curvedly from the lower retention portion to extending in a different surface with that of the lower retention portion for elastically engaging with the upper terminal.

Other objects, advantages and novel features of the invention will become more apparent from the following detailed description of a preferred embodiment when taken in conjunction with the accompanying drawings.

DETAILED DESCRIPTION OF THE INVENTION

FIGS. 3-7 shows an electrical connector 100 in accordance with a first embodiment of the present invention. The electrical connector 100 used for electrically connecting a central process unit (CPU, not shown) and a printed circuit board (not shown), comprises an insulative housing 1 with a plurality of passageways 11 and a plurality contacts 2 received in the passageways 11.

Figure 1:
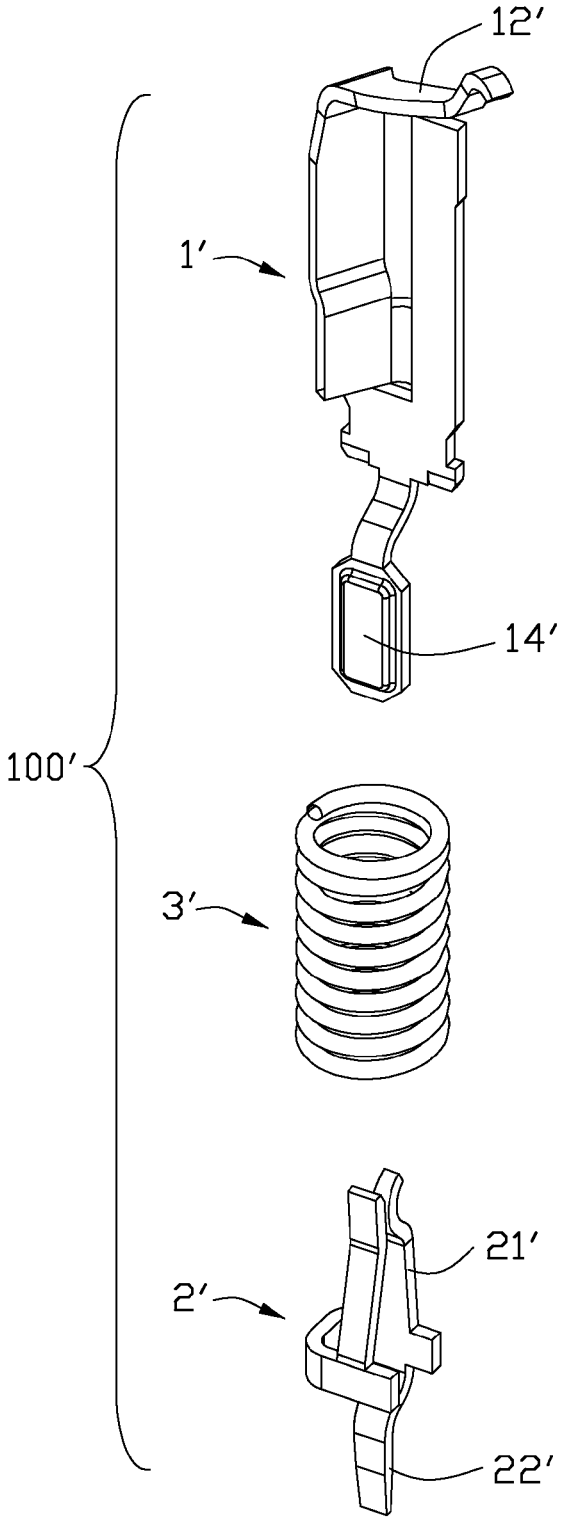
FIG. 1 is an exploded perspective view of a conventional electrical contact.
Figure 2:
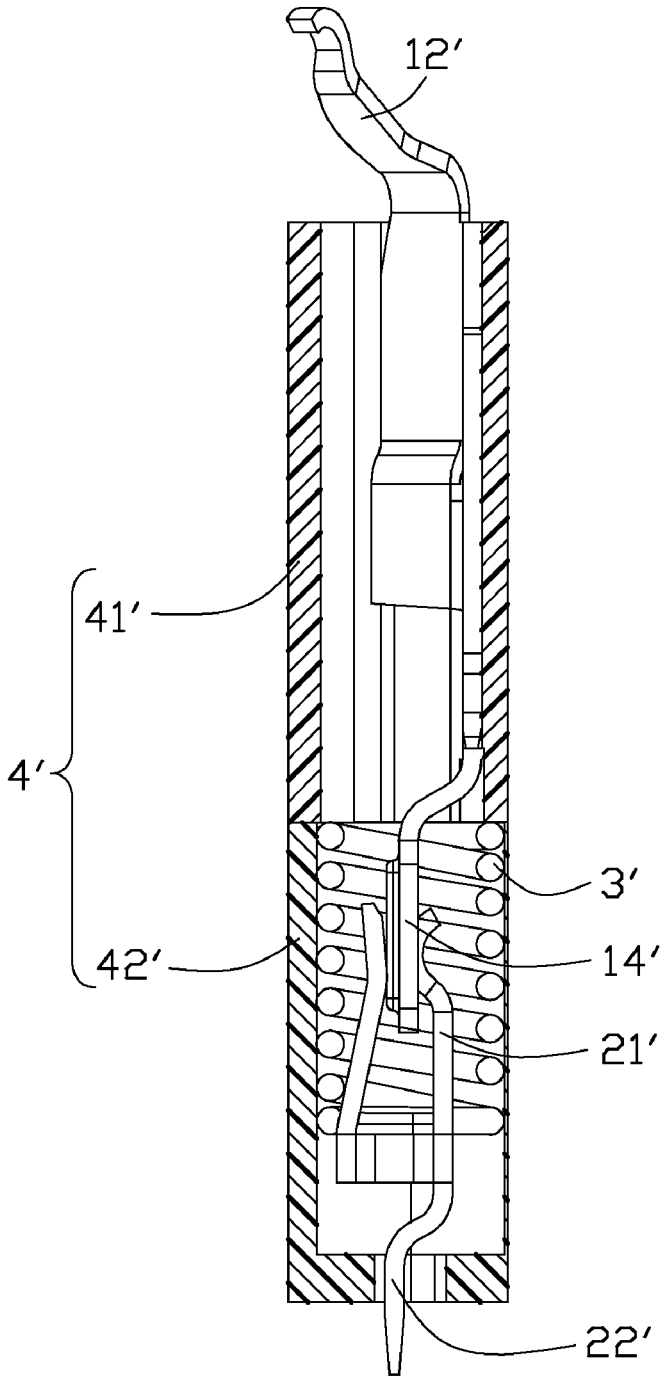
FIG. 2 is a cross-sectional view of a conventional electrical connector with the electrical contact of FIG. 1.
Figure 3:
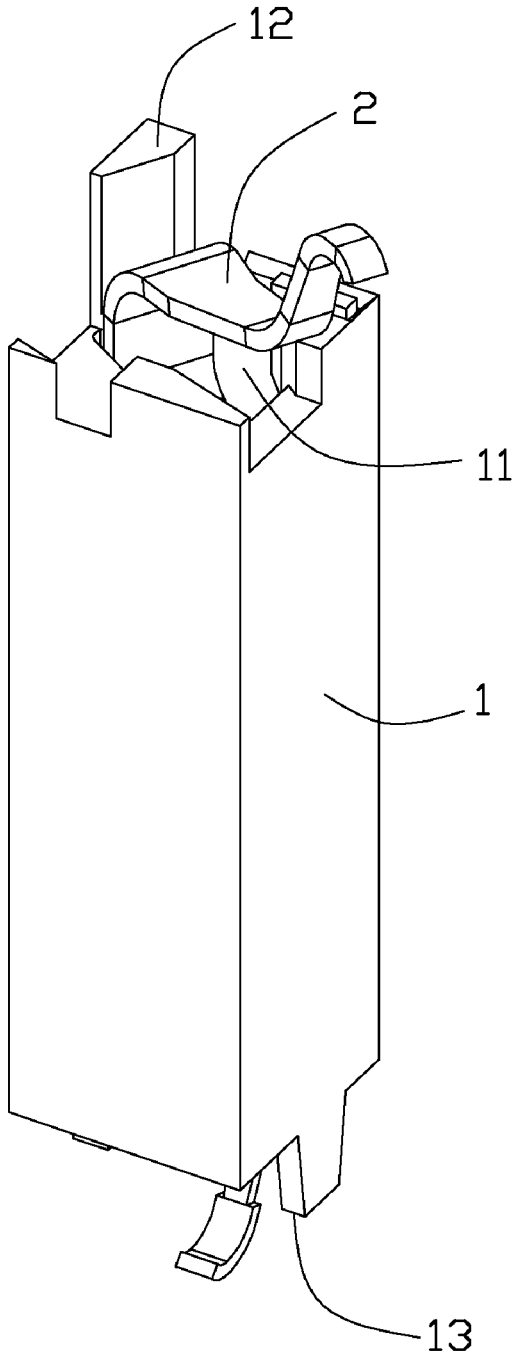
FIG. 3 is an assembled view of a passageway with a contact received therein in accordance with a first embodiment of the present invention, only showing one passageway and one contact.
Figure 4:
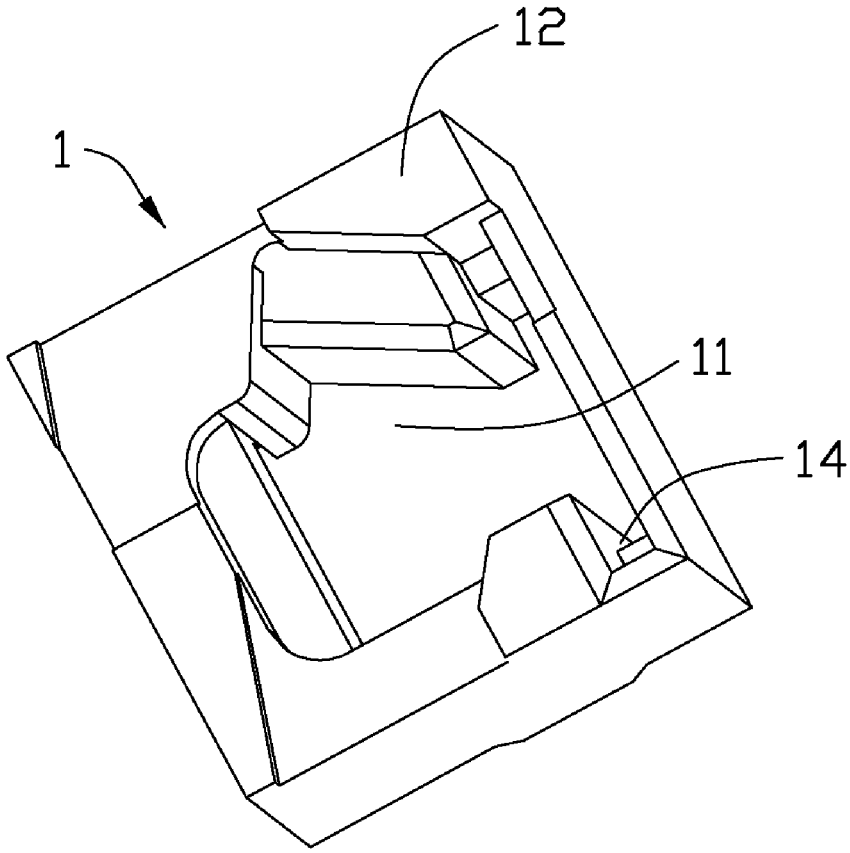
FIG. 4 is a perspective view of the passageway in accordance with the first embodiment of the present invention.
Figure 5:
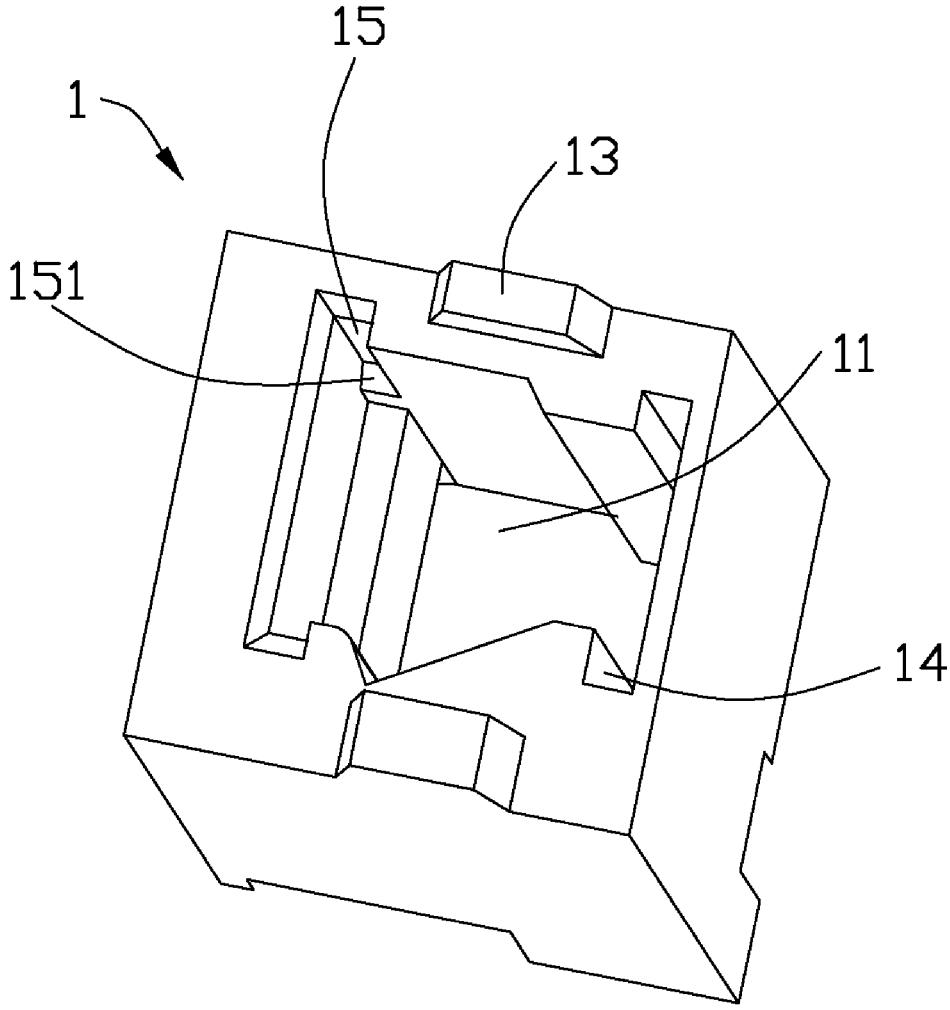
FIG. 5 is similar with FIG. 4, but taken from another side.

Referring to FIGS. 3-5, the insulative housing 1 includes a top surface 12, a bottom surface 13, and a plurality of passageways 11 passing through the top surface 12 and the bottom surface 13. The passageway 11 includes a first recess 14 and a second recess 15 at two opposite sides thereof. The first recess 14 passes through the insulative housing 1, and the second recess 15 is recessed from the bottom surface 13 and does not extend through the top surface 12 to form with a stopper 151 thereof.

Figure 6:
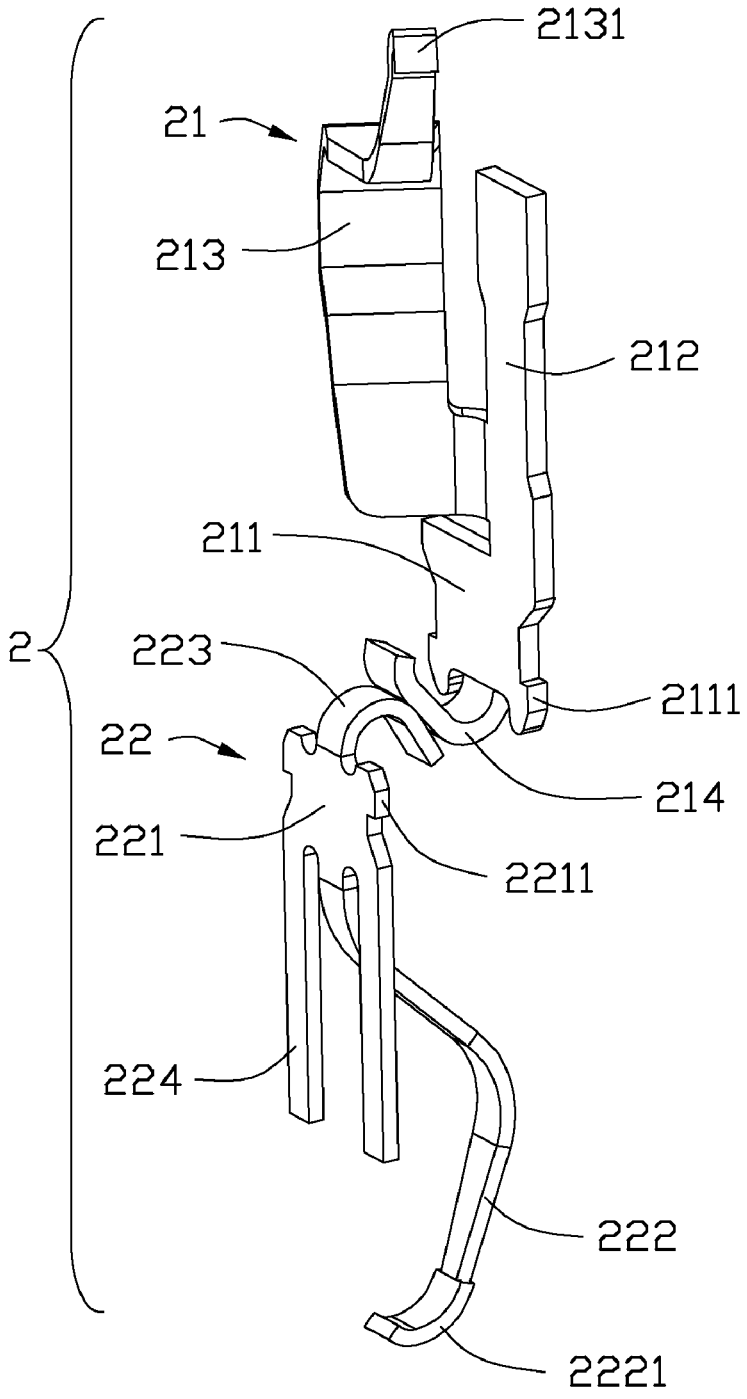
FIG. 6 is a perspective view of the contact in accordance with the first embodiment of the present invention.
Figure 7:
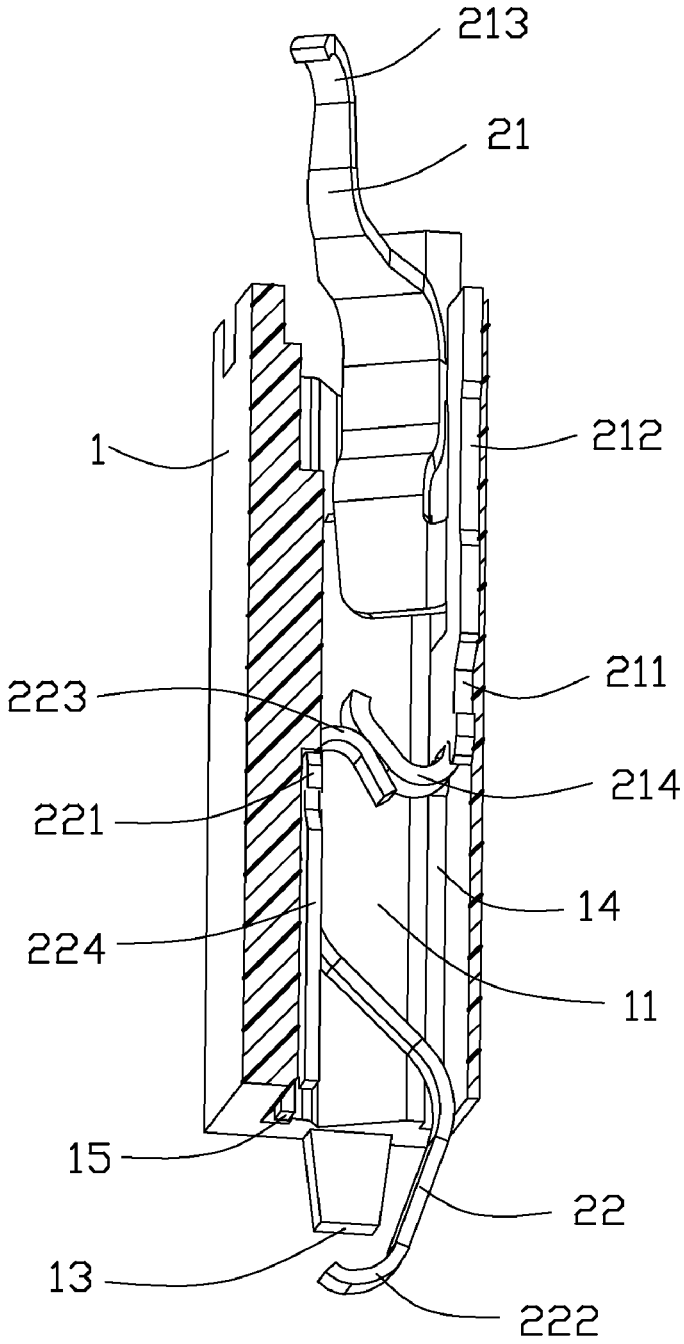
FIG. 7 is a cross-sectional view of the contact received in the passageway of FIG. 3.

Referring to FIGS. 6 to 7, each contact 2 has an upper terminal 21 and a lower terminal 22 disposed below the upper terminal 21. The upper terminal 21 has an upper retention portion 211 extending along a vertical direction, and an upper connecting portion 212 adapted to connect a strip (not shown) and extending vertically and upwardly from a top of the upper retention portion 211. The upper terminal 21 further has an upper spring arm 213 extending from one lateral side of the upper connecting portion 212 and an upper engaging portion 214 extending from a bottom end of the upper retention portion 211 and bent upwardly. The upper spring arm 213 extends beyond the top surface 12 of the insulative housing 1 and toward a direction, and has an upper contacting portion 2131 to electrically connect with the CPU (not shown). The upper retention portion 211 is formed with a planar board, and a plurality of barbs 2111 are designed on two sides of the upper retention portion 211. The upper retention portion 211 is fixed in the first recess 14 by the barbs 2111. An obtuse angle is defined between the upper spring arm 213 and the upper connecting portion 212.

The lower terminal 22 includes a planar lower retention portion 221, a lower spring arm 222 extending downwardly from the lower retention portion 221, and a lower engaging portion 223 extending upwardly from the lower retention portion 221. The lower retention portion 221 is fixed in the second recess 15 owing to interfere with a plurality of tabs 2211 defined on two sides of the lower retention portion 221. A pair of connecting portion 224 extend from the lower retention portion 221 and are disposed on two opposite sides of the lower spring arm 222. The lower spring arm 222 extends toward a different direction respective to the upper spring arm 213 and is substantially formed as a "C" shape. The lower spring arm 222 has a lower curved contacting portion 2221 extending outwardly from the bottom surface 13 of the insulative housing 1 to engage with the printed circuit board (not shown).

FIG. 7 is a schematic drawing and only show one contact 2 and one passageway 11. The upper engaging portion 214 of the upper terminal 21 and the lower engaging portion 223 of the lower terminal 22 are both like a hook, the difference therebetween is that the upper engaging portion 214 opened upwardly, while the lower engaging portion 223 opened downwardly. In assembly, the lower terminals 22 are mounted into the passageways 11 from the bottom surface 13 of the insulative housing 1, and top ends of the lower retention portions 221 are against on the stoppers 151 of the second recesses 15; and then, the upper terminals 21 are mounted into the passageways 11 from the top surface 12 of the insulative housing 1, and the upper engaging portion 214 contact with the lower engaging portion 223 to achieve electrical connection therebetween.

Figure 8:
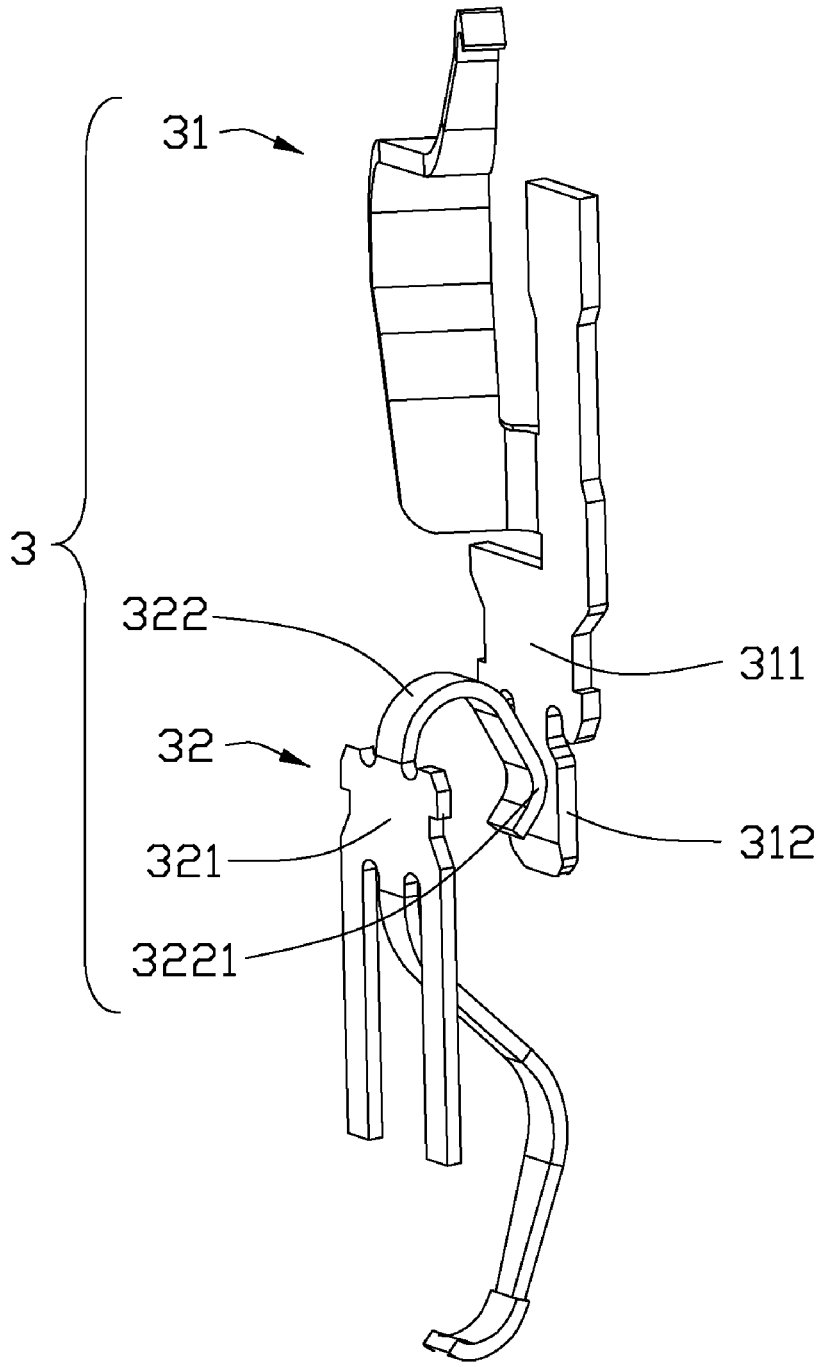
FIG. 8 is a perspective view of a contact in accordance with a second embodiment of the present invention.

Referring to FIG. 8, an electrical connector in accordance with a second embodiment of this invention is similar to the electrical connector 100 in accordance with the first embodiment, except partially structure of a contact 3, so, an insulative housing with a passageway is omitted. An upper terminal 31 of the contact 3 is similar with the upper terminal 21 in the first embodiment, but has a vertically planar engaging portion 312 extending from a bottom end of an upper retention portion 311. A lower terminal 32 is similar to the lower terminal 22 of the electrical connector 100 in the first embodiment, and a bent mating portion 3221 is formed with a free end of a lower engaging portion 322. The bent mating portion 3221 contacts with the engaging portion 312 to establish an electrical connection between the upper terminal 31 and the lower terminal 32.

Figure 9:
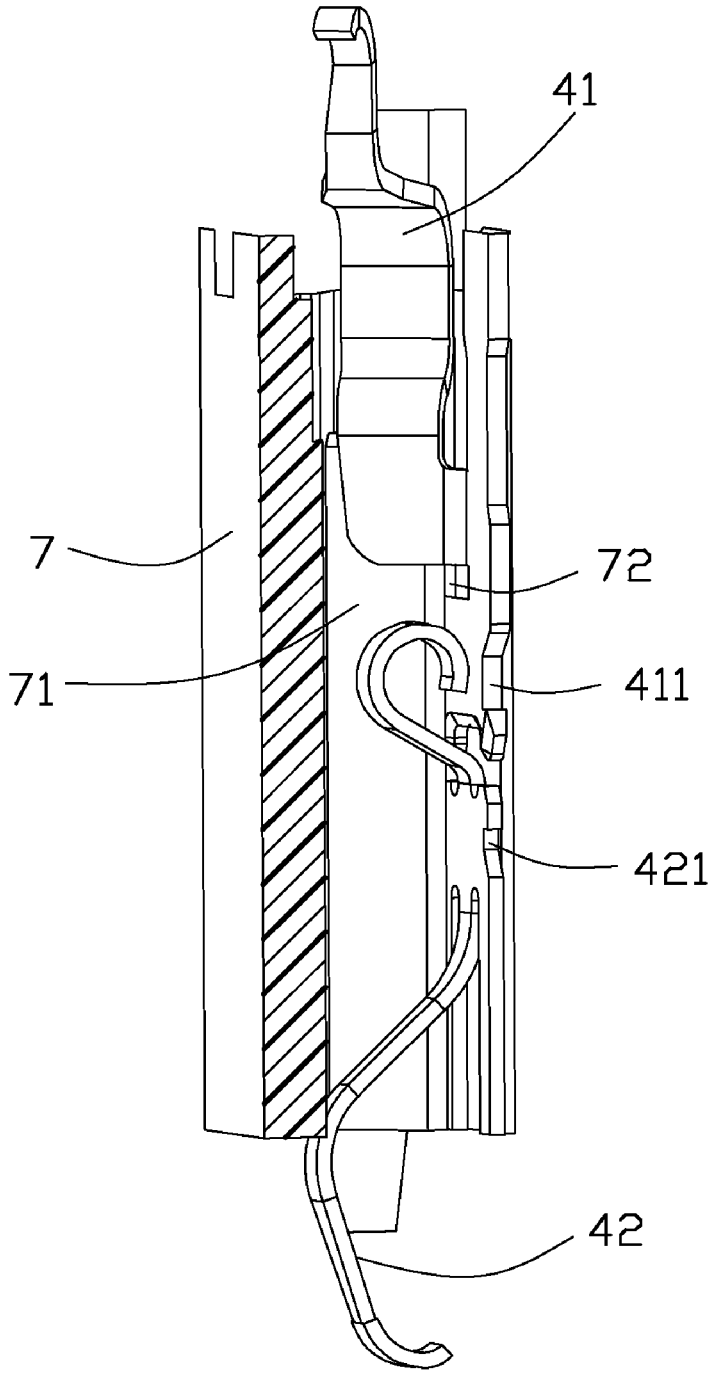
FIG. 9 is a cross-sectional view of a contact received in the passageway in accordance with a third embodiment of the present invention.
Figure 10:
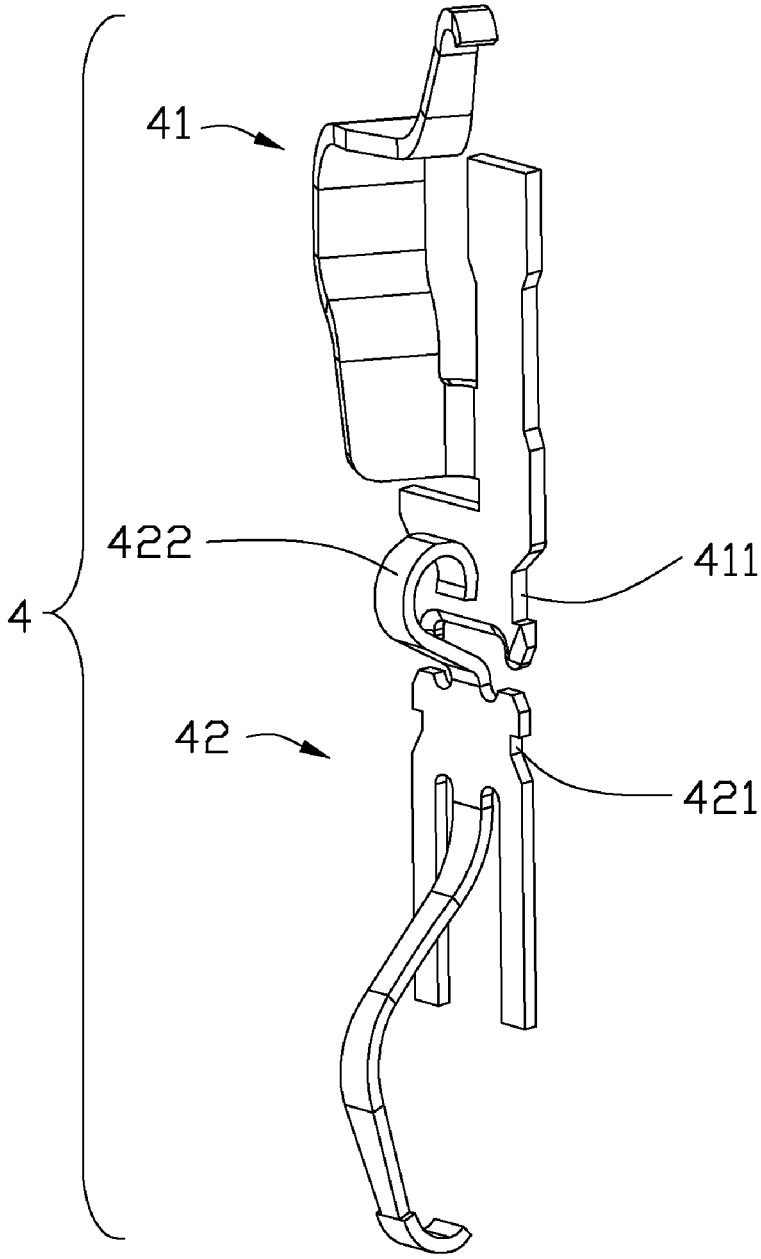
FIG. 10 is a perspective view of the contact of FIG. 9.

FIGS. 9 and 10 show an electrical connector in accordance with a third embodiment including an insulative housing 7 with passageways 71 and a plurality of contacts 4 received thereof, and including an upper terminal 41 and a lower terminal 42. Passageways 71 of the insulative housing 7 defines a recess 72 at one side thereof, and an upper retention portion 411 of the upper terminal 41 and a lower retention portion 421 of the lower terminal 42 are both formed with planar board and positioned in a same vertical plate so as to both be fixed in the recess 72. A lower engaging portion 422 of the lower terminal 42 is substantially configured as an upper part of "S". The engaging portion 422 directly contacts with the upper retention portion 411 to achieve electrical connection therebetween.

Figure 11:
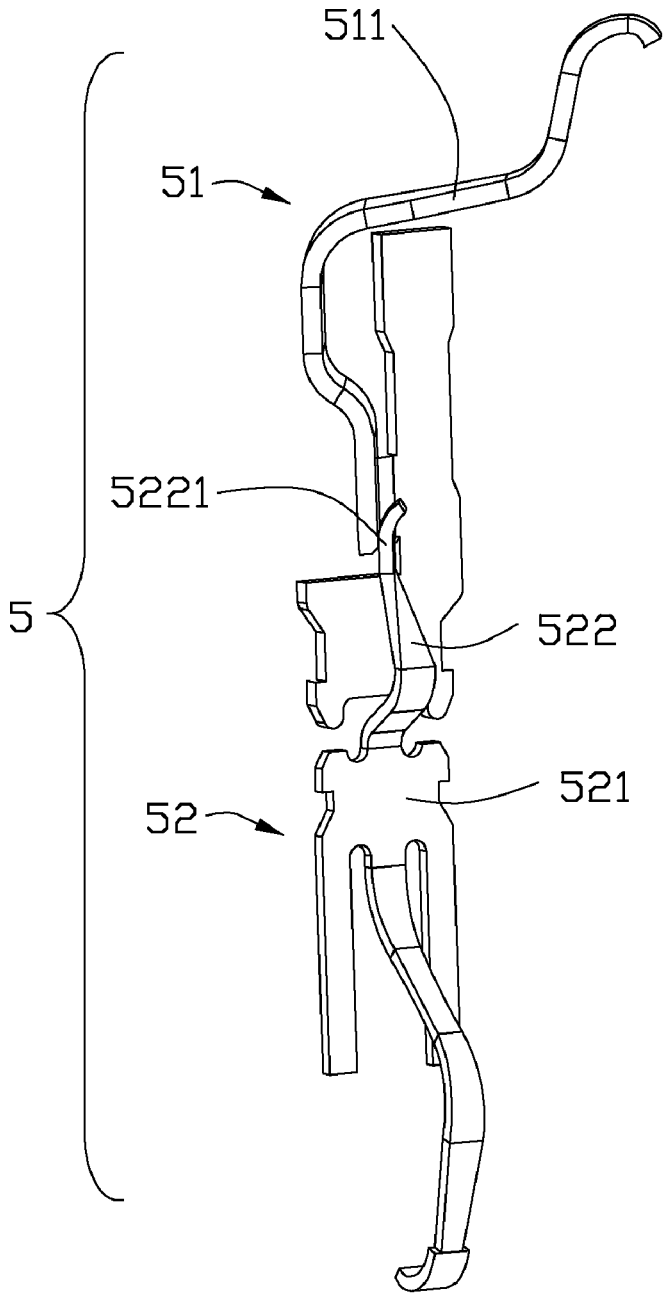
FIG. 11 is a perspective view of a contact in accordance with a fourth embodiment of the present invention.

Referring to FIG. 11, an electrical connector in accordance with a fourth embodiment is similar to the electrical connector in the third embodiment except partially structure of a contact 5. The contacts includes an upper terminal 51 and a lower terminal 52 with a lower retention portion 521, wherein a lower engaging portion 522 of the lower terminal 52 is twisted and has a mating portion 5221 on a top end thereof, which extends upwardly till touching a lower end of an upper spring arm 511. The mating portion 5221 abuts against one side of the upper spring arm 511 to establish an electrical connection therebetween.

Figure 12:
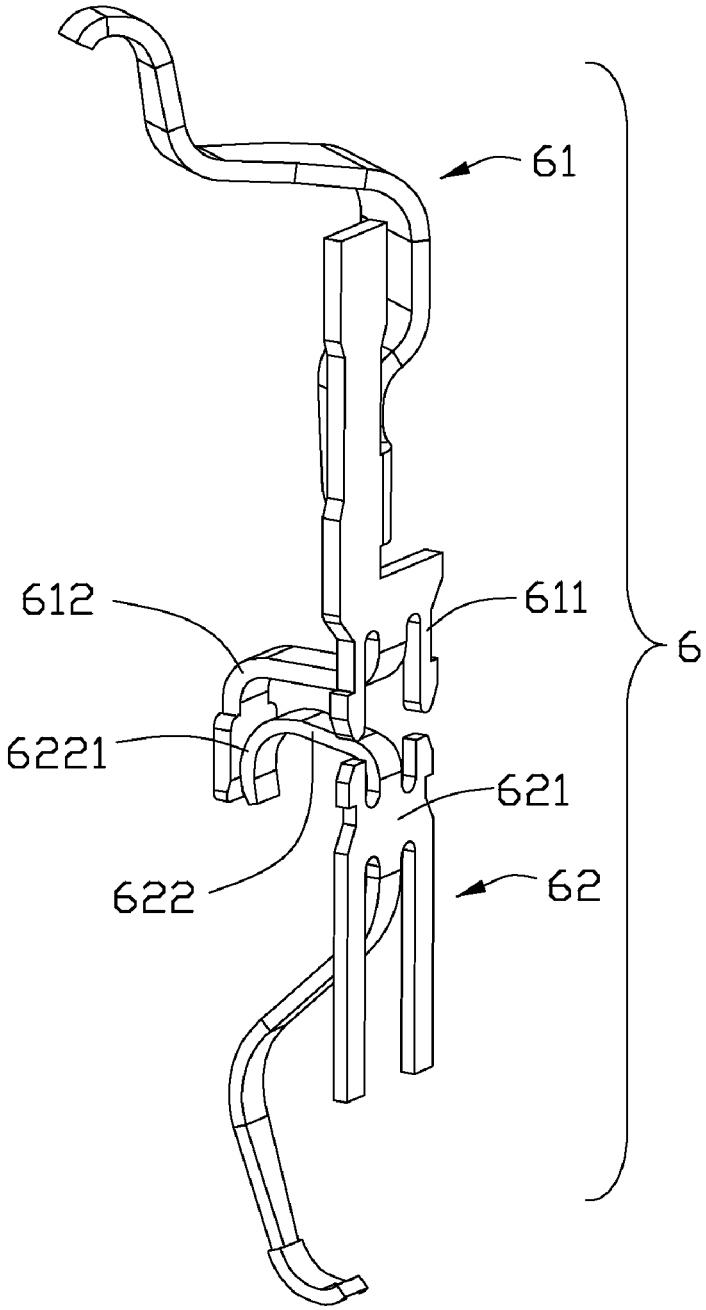
FIG. 12 is a perspective view of a contact in accordance with a fifth embodiment of the present invention.

Referring to FIG. 12, an electrical connector in accordance with a fifth embodiment of this invention is similar to the electrical connector in the third and the fourth embodiment except partially structure of a contact 6. A lower terminal 62 has a lower engaging portion 622, which extends upwardly from a lower retention portion 621, then extends horizontally, and further extends downwardly to form a curved mating portion 6221. An upper terminal 61 has an upper engaging portion 612, which extends from an upper retention portion 611 and locates at a same side with the lower engaging portion 622. An end of the upper engaging portion 612 is a vertical planar board to engage with the mating portion 6221.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical connector comprising:

an insulative housing having a top surface, a bottom surface, and a plurality of passageways extending through the top and the bottom surfaces;

a plurality of contacts received in the passageways, respectively, each contacts comprising: an upper terminal mounted into the passageway from the top surface, and configured with an upper retention portion and an upper spring arm extending beyond the top surface of the insulative housing; and a lower terminal mounted into the passageway from the bottom surface, and configured with a lower retention portion, a lower spring arm extending beyond the bottom surface of the insulative housing, and a lower engaging portion extending upwardly from the lower retention portion to elastically contact with the upper terminal;

wherein the upper retention portion is configured with a planar board, and an upper connecting portion extends upwardly from the retention portion and has an angle with the upper spring arm; the lower retention portion is formed with a planar board, and a pair of lower connecting portions extend downwardly from the lower retention portion and located at two sides of the lower spring arm.

2. The electrical connector as claimed in claim 1, wherein the lower engaging portion is twisted and has a mating portion on a top end thereof which engages with a bottom of the upper spring arm.

3. The electrical connector as claimed in claim 1, wherein the lower engaging portion extends upwardly from the lower retention portion, then extends horizontally, and further extends downwardly to form a curved mating portion, and the upper terminal has an upper engaging portion having a corresponding shape with the lower engaging portion.

4. The electrical connector as claimed in claim 1, wherein the passageway of the insulative housing includes a first recess and a second recess at two opposite sides thereof to fix the upper retention portion and the lower retention portion, respectively.

5. The electrical connector as claimed in claim 4, wherein the upper terminal includes an upper engaging portion extending from the upper retention portion, the upper engaging portion and the lower engaging portion are both like a hook and engage with each other, and the hook of the upper engaging portion is opened upwardly, while the hook of the lower engaging portion is opened downwardly.

6. The electrical connector as claimed in claim 4, wherein the upper terminal includes a planar upper engaging portion extending downwardly from the retention portion and touching with a lower mating portion which is bent at a free end of the lower engaging portion.

7. The electrical connector as claimed in claim 1, wherein a recess is defined in the passageway to fix both the upper retention portion of the upper terminal and the lower retention portion of the lower terminal.

8. The electrical connector as claimed in claim 7, wherein the upper retention portion is formed as planar plate, and the lower engaging portion is substantially formed as an upper part of "S" to touch with the upper retention portion.

9. An electrical connector used for electrically connecting a CPU and a printed circuit board, comprising:

an insulative housing having a top surface, a bottom surface, and a plurality of passageways extending through the top and the bottom surfaces;

a plurality of contacts received in the passageways respectively, comprising:

an upper terminal configured with a planar upper retention portion and an upper spring arm extending beyond the top surface of the insulative housing toward one direction; and a lower terminal configured with a lower retention portion, a lower spring arm extending beyond the bottom surface of the insulative housing toward a different direction respective to the upper spring arm, and a lower engaging portion extending curvedly from the lower retention portion and terminated in a different surface with regard to that of the lower retention portion for elastically engaging with the upper terminal;

wherein an upper connecting portion extends upwardly from the retention portion and has an angle with the upper spring arm; and a pair of lower connecting portions extend downwardly from the lower retention portion and located at two sides of the lower spring arm.

10. The electrical connector as claimed in claim 9, wherein the passageway of the insulative housing includes a first recess and a second recess at opposite sides thereof to fix the upper retention portion and the lower retention portion, respectively.

11. The electrical connector as claimed in claim 9, wherein the passageway of the insulative housing defines a recess to fix both the upper retention portion of the upper terminal and the lower retention portion of the lower terminal.

12. The electrical connector as claimed in claim 9, wherein the lower terminal is located below the upper terminal.

13. The electrical connector as claimed in claim 9, wherein the upper terminal further includes an upper engaging portion extending from the upper retention portion to contact with the lower engaging portion to obtain a well electrical connection between the upper terminal and the lower terminal.

14. The electrical connector as claimed in claim 9, wherein the lower engaging portion directly contact with the upper retention portion to obtain a well electrical connection between the upper terminal and the lower terminal.

15. The electrical connector as claimed in claim 9, wherein the insulative housing is only one piece, and the upper terminal mounted into the insulative housing from the top surface and the lower terminal mounted into the insulative housing from the bottom surface.

16. An electrical connector comprising:

an insulative housing defining a plurality passageways each extending through opposite upper and bottom surfaces of the housing in a vertical direction and including an upper portion and a lower portion thereof; a plurality of upper contacts and a plurality of lower contacts assembled into the corresponding passageways, each of the upper contacts downwardly inserted into the corresponding passageway from the upper surface and defining an upper retention section retaining the upper contact in the upper portion, and an upper contacting section extending upwardly above the upper surface in a resilient manner, and each of the lower contacts upwardly inserted into the corresponding passageway from the bottom surface and defining a lower retention section retaining the lower contact in the lower portion, and a lower contacting section extending downwardly below the bottom surface in the resilient manner; wherein in each passageway, at least one of the corresponding upper contact and the corresponding lower contact defines an abutment portion to touch the other for electrical connection therebetween, and the upper contacting section and the lower contacting section are asymmetrical with each other to have corresponding upper and lower contacting points not aligned with each other in said vertical direction.

17. The electrical connector as claimed in claim 16, wherein in each passageway, the corresponding upper contacting section extend in a first plane while the corresponding lower contacting section extend in a second plane angled to said first plane.

18. The electrical connector as claimed in claim 16, wherein the abutment portion is resilient.

19. The electrical connector as claimed in claim 18, wherein in each passageway another abutment portion of the other of the corresponding upper contact and the corresponding lower contact is resilient to resiliently abut against said abutment portion of said one of the corresponding upper contact and the corresponding lower contact.

* * * * *